US005481846A

United States Patent [19]

Macchietto

[11] Patent Number: 5,481,846

[45] Date of Patent: Jan. 9, 1996

[54] SUPPORT POLE HAVING A BELL-SHAPED LOWER END

[75] Inventor: Carl J. Macchietto, Omaha, Nebr.

[73] Assignee: Valmont Industries, Inc., Valley, Nebr.

[21] Appl. No.: 409,843

[22] Filed: Mar. 27, 1995

[51] Int. Cl.[6] ..... E04C 3/32

[52] U.S. Cl. ..... 52/720.1; 52/726.4; 52/731.4; 52/732.3; 52/736.1; 52/737.6; 52/296; 52/297; 248/158

[58] Field of Search ..... 52/296, 726.4, 52/731.4, 732.3, 736.1, 737.6, 301, 297, 720.1; 403/265, 270, 271, 272; 248/158; 404/9

[56] References Cited

U.S. PATENT DOCUMENTS

| | | | |
|---|---|---|---|
| 3,282,001 | 11/1966 | Bigalow | 52/301 |
| 3,521,413 | 7/1970 | Scott et al. . | |
| 3,541,746 | 11/1970 | Scott . | |
| 3,628,296 | 12/1971 | Henry . | |
| 3,630,474 | 12/1971 | Minor . | |
| 3,645,057 | 2/1972 | Kaplan | 52/296 X |
| 3,839,835 | 10/1974 | Meyer | 52/296 |
| 3,847,334 | 11/1974 | Forsberg et al. . | |
| 4,007,564 | 2/1977 | Chisholm . | |
| 4,617,768 | 10/1986 | Gebelius . | |
| 4,673,157 | 6/1987 | Wells | 52/296 X |
| 4,813,201 | 3/1989 | Parsons et al. . | |
| 5,117,607 | 6/1992 | Bourdon . | |

*Primary Examiner*—Carl D. Friedman
*Assistant Examiner*—Christopher Todd Kent
*Attorney, Agent, or Firm*—Zarley, McKee, Thomte, Voorhees & Sease; Dennis L. Thomte

[57] ABSTRACT

A support pole comprising a pole member secured to a flat base plate. A majority of the length of the pole member has a square-tube cross-section. The pole member is provided with a bell-shaped portion at its lower end which is secured to the base plate.

10 Claims, 3 Drawing Sheets

SUPPORT POLE HAVING A BELL-SHAPED LOWER END

BACKGROUND OF THE INVENTION

1. Field of the Invention

This invention relates to a support pole for supporting lights, antennas, cameras, etc., and more particularly to a square-tube type support pole having a bell-shaped lower end portion.

2. Description of the Related Art

Support poles such as poles for supporting lights, antennas, cameras, etc., or the like, are commonly constructed so as to have a square-tube cross-section. The support pole is normally comprised of an elongated pole member having its lower end welded to a flat base plate which is anchored to a suitable footing or the like.

Although the square-tube support poles experience a higher rate of structural failure than poles having a round cross-section, the square-tube poles are perhaps the most widely used poles in the support pole industry.

It has been discovered that the lower ends of the square-tube poles develop fractures or cracks therein adjacent the corners thereof. It is believed that such fractures or cracks are due to metal fatigue and that the cracks and fractures are the primary reason for the structural failure of the poles.

SUMMARY OF THE INVENTION

A support pole is described which includes an elongated pole member having its lower end welded or otherwise secured to a flat base plate. The pole member has a square-tube cross-section for a vast majority of its length, but has a bell-shaped lower end portion which is preferably welded to the base plate.

It is therefore a principal object of the invention to provide an improved support pole.

A further object of the invention is to provide a support pole having a bell-shaped lower end portion which is welded or otherwise secured to a flat base plate.

Yet another object of the invention is to provide a support pole having superior resistance to the formation of cracks or fractures at the lower end.

These and other objects will be apparent to those skilled in the art.

DESCRIPTION OF THE PREFERRED EMBODIMENT

Figure 1:
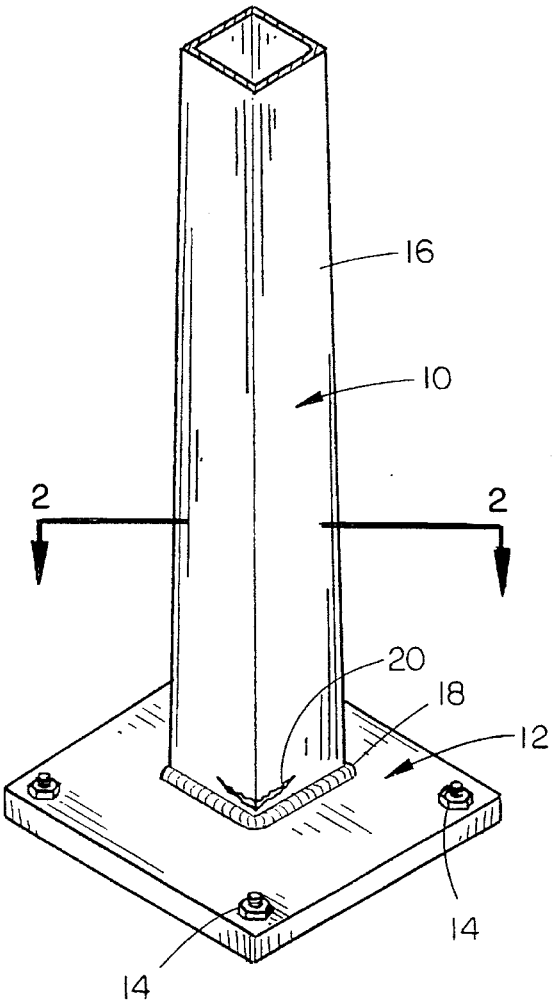
FIG. 1 is a partial perspective view of a prior art support pole.
Figure 2:
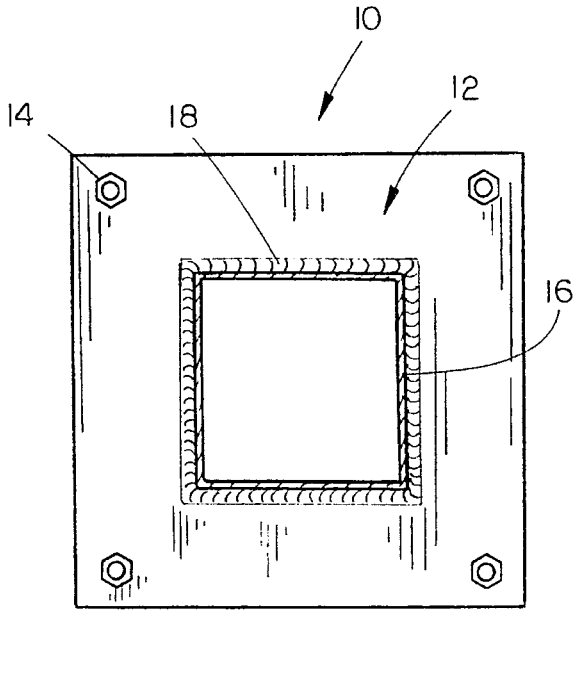
FIG. 2 is a sectional view of the pole of FIG. 1 as seen on lines 2—2.

FIG. 1 illustrates a conventional support pole such as a light pole or the like. The support pole 10 of FIG. 1 is commonly utilized to support lights, antennas, cameras, etc. FIG. 2 is a horizontal cross-section as seen on lines 2—2 of FIG. 1. As seen in FIG. 1, the conventional support pole 10 includes a flat, generally square base plate 12 which is secured to a suitable concrete footing or the like by means of anchor bolts 14. Base plate 12 is sometimes secured to steel shafts extending upwardly from the ground as well. Pole 10 also includes a pole member 16 which is secured to base plate 12 by weldment 18. Normally, the lower end of pole member 16 is received by a square opening in base plate 12 with the pole member 16 being welded to the inside and outside surfaces of base plate 12. A vast majority of the pole members of the conventional utility poles have a square cross-section as seen in FIG. 2. In some cases, the pole member 16 tapers from its lower end to its upper end. Conventionally, the lower end of the pole member 16 is welded to the base plate 12, as stated. However, the lower end of the pole member 16 may be positioned on, and welded to, the upper surface of the base plate 12.

It has been found that those support poles having a square, horizontal cross-section experience a greater structural failure rate than do poles having a circular, horizontal cross-section. It has been found that the pole members 16 of the support poles 10 tend to develop cracks or fractures 20 in the walls thereof in the vicinity of the corners thereof just above the base plate, which are due to metal fatigue. It is for this reason that the instant invention has been developed.

Figure 3:
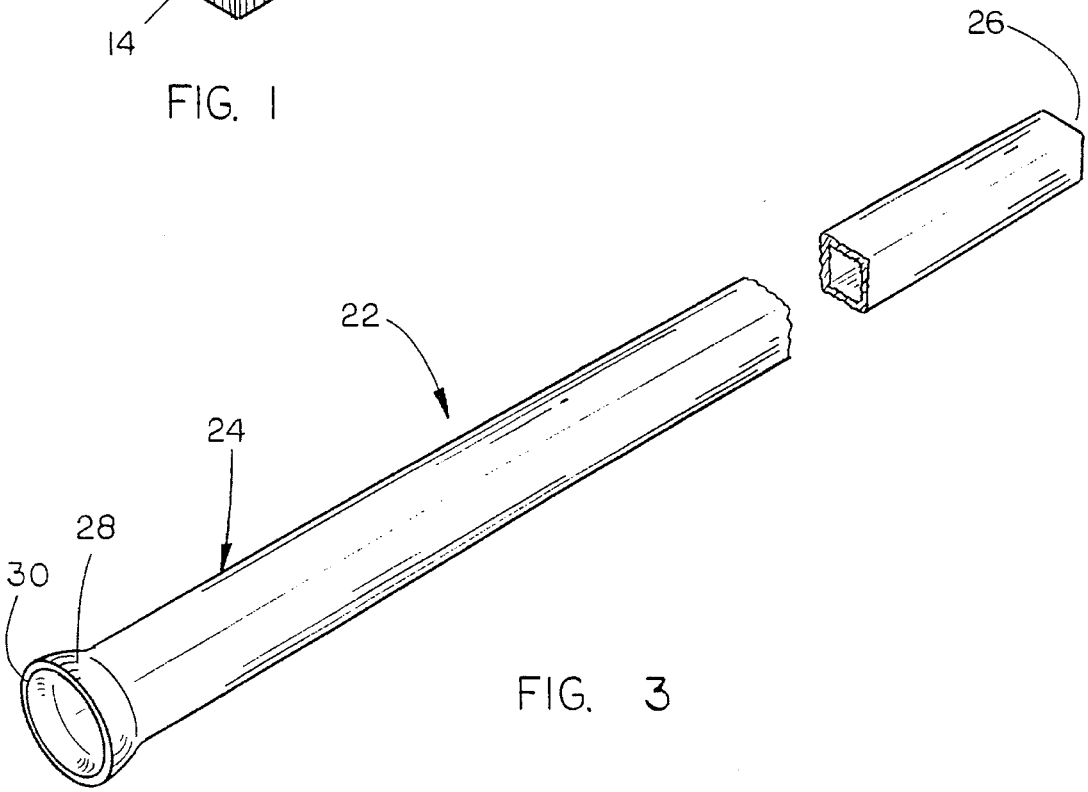
FIG. 3 is a partial perspective view of the pole member portion of the support pole of this invention.
Figure 4:
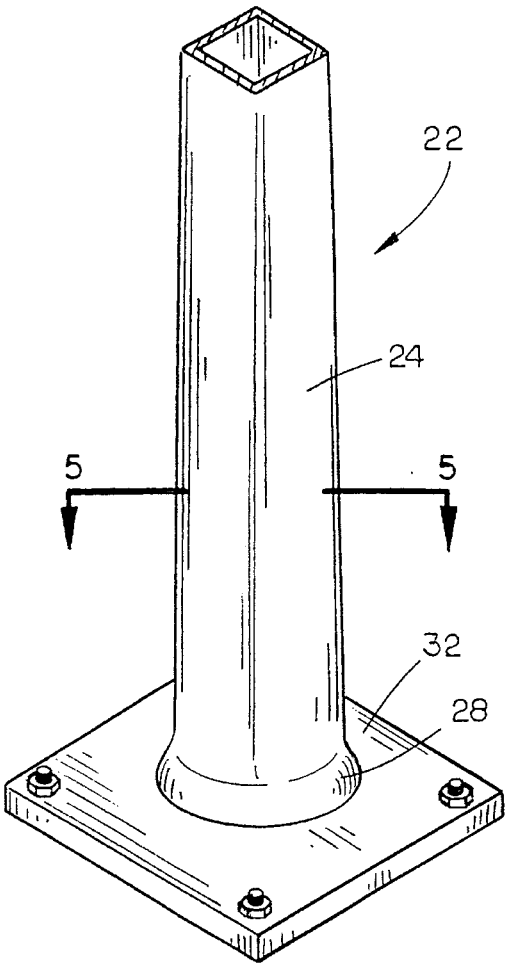
FIG. 4 is a partial perspective view of the support pole of this invention.
Figure 5:
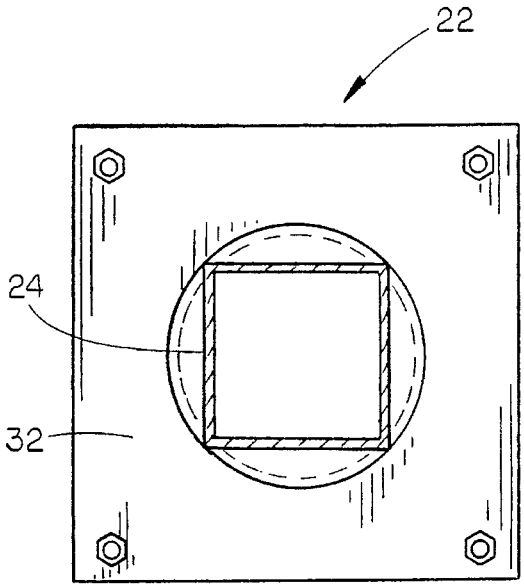
FIG. 5 is a sectional view as seen on lines 5—5 of FIG. 4.
Figure 6:
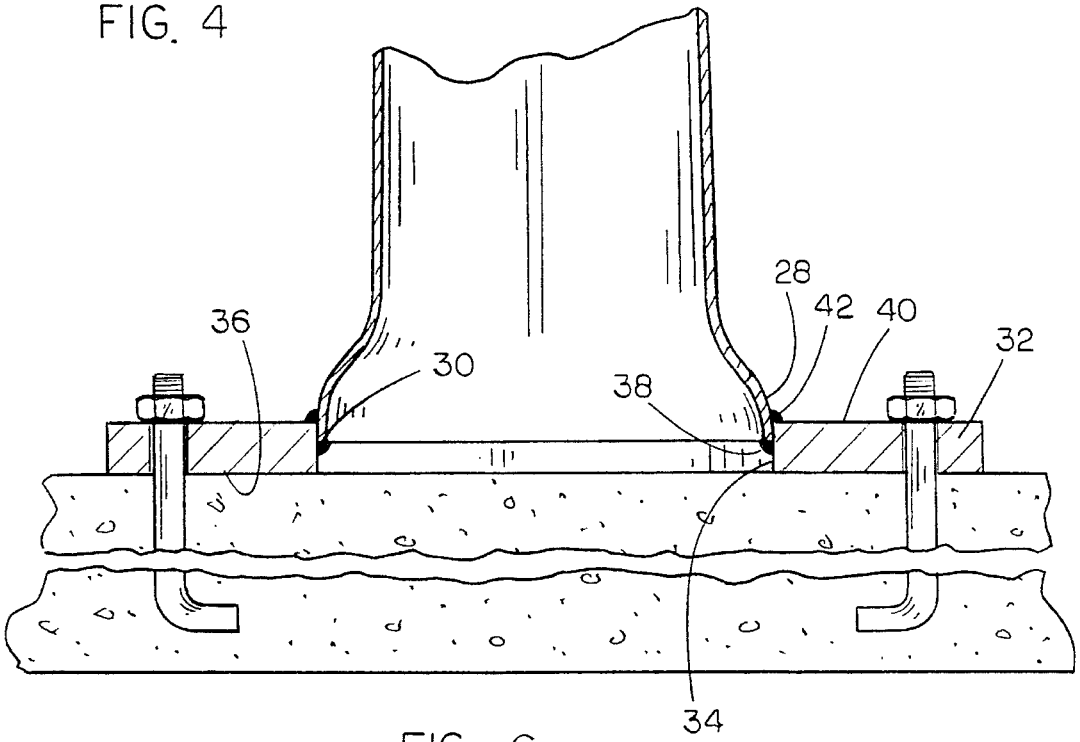
FIG. 6 is a partial vertical sectional view illustrating one means of attaching the pole member portion of the support pole to the base plate portion of the support pole.
Figure 7:
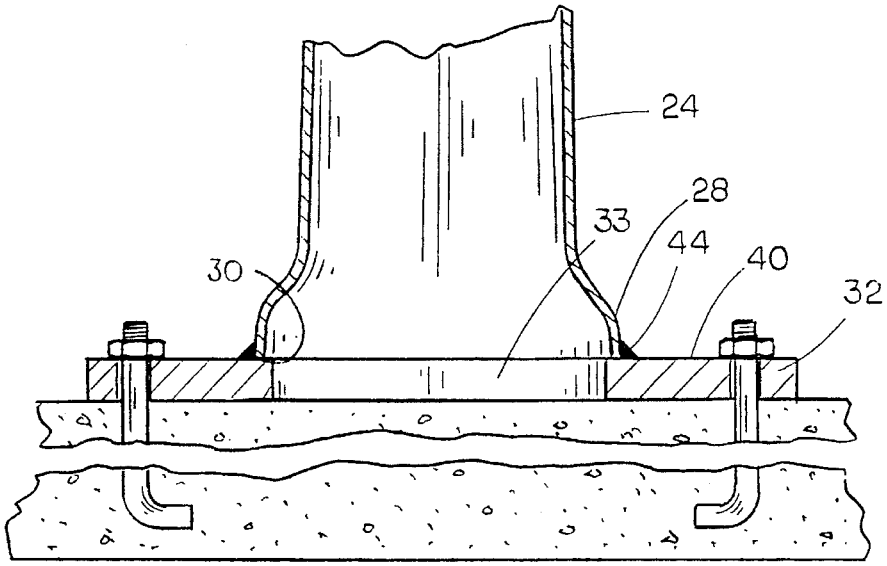
FIG. 7 is a partial vertical sectional view illustrating another means of attaching the pole member portion to the base plate portion.
Figure 8:
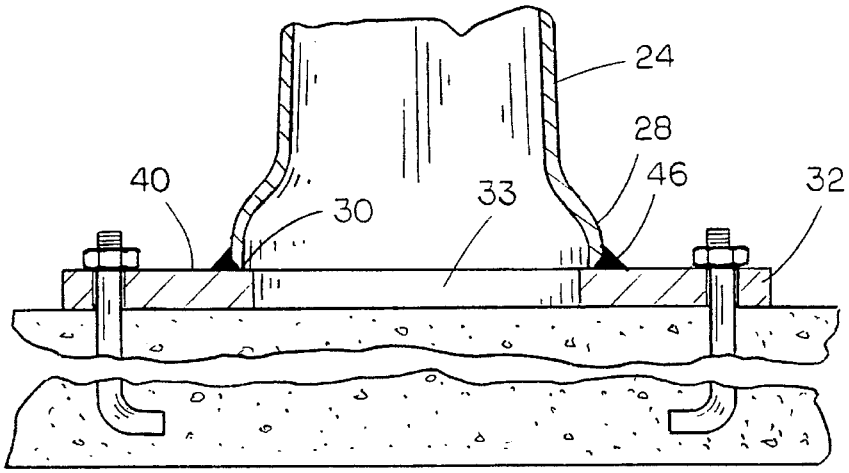
FIG. 8 partial vertical sectional view illustrating yet another means of attaching the pole member portion to the base plate portion.
Figure 9:
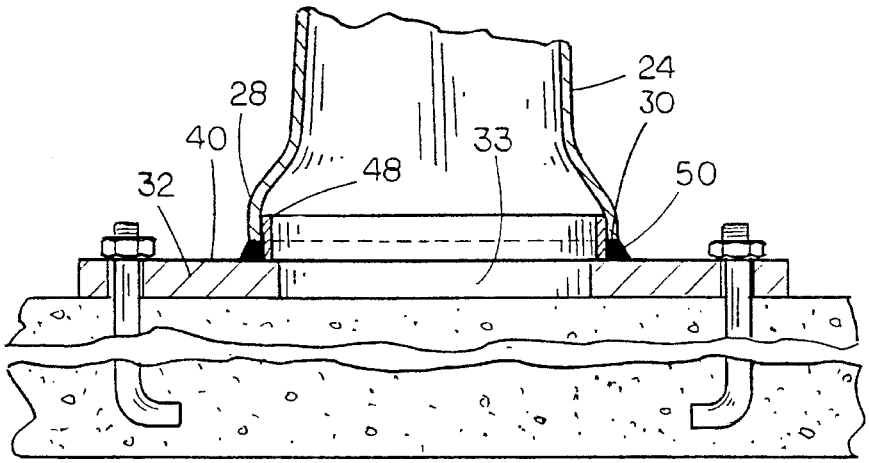
FIG. 9 is a partial vertical sectional view illustrating still another means of attaching the pole member portion of the support pole to the base plate portion of the support pole.

FIGS. 3–9 illustrate the support pole of this invention which is referred to generally by the reference numeral 22 and which includes a pole member portion and a base plate portion. FIGS. 4–6 illustrate one method of securing the pole member to the base plate, while FIGS. 7, 8 and 9 illustrate various other methods of securing the pole member to the base plate. In each instance, however, the configuration of the lower end of the pole member does not change, with only the manner of attaching the pole member to the base plate varying. As seen in FIG. 3, the support pole 22 includes an elongated pole member 24 having a square, horizontal cross-section for a vast majority of its length. The pole member 24 may be tapered so as to have a smaller cross-section at its upper end 26. The pole member 22 is provided with a bell-shaped lower end portion 28 having a circular lower end 30.

As illustrated in FIG. 6, the base plate 32 may have a circular, centrally located opening 34 formed therein which receives the bell-shaped lower end portion 28. In the method of attachment illustrated in FIG. 6, the lower end 30 of bell-shaped lower end portion 28 is spaced above the bottom surface 36 of the base plate 32. The lower end 30 is welded to base plate 32 at 38. The exterior surface of bell-shaped lower end portion 28 is welded to the top surface 40 of base plate 32 at 42.

FIGS. 7 and 8 illustrate two alternative methods of attaching the pole member 24 to a base plate 32 when the base plate 32 does not have a circular opening formed therein adapted to receive the lower end of the pole member. However, the base plate 32 may have an opening 33 formed therein to permit electrical wires to extend upwardly therethrough for connection to the light, camera, etc., supported on the pole. The opening 33 may also be provided to allow for ventilation, drainage, etc. In FIG. 7, the lower end 30 of bell-shaped lower end portion 28 is positioned on the top surface with a weldment 44 extending between the outside surface of bell-shaped lower end portion 28 and the top surface 40 of base plate 32. In FIG. 8, the lower exterior surface of lower end 30 is tapered so that the weldment 46 extends partially beneath the tapered area of lower end 30.

FIG. 9 illustrates yet another method of attaching the pole member 24 to the base plate 32. In the embodiment of FIG. 9, a back-up ring 48 is first positioned on base plate 32. The bell-shaped lower end portion 28 is then positioned so as to partially embrace ring 48 as seen in FIG. 9, with the lower end 30 being spaced above top surface 40. Weldment 50 is then utilized, as seen in FIG. 9, to weld lower end 30 to ring 48 and to base plate 32.

In all of the embodiments, pole member 24 is preferably comprised of a suitable metal material such as steel, aluminum, etc. Base plate 32 is also preferably constructed from a suitable metal material such as steel, aluminum, etc. Pole member 24 is preferably secured to the base plate 32 by welding. However, it is possible that the pole member 24 could be secured to the base plate 32 by other means such as epoxy, etc.

In all of the embodiments illustrated herein, it is believed that the potential cracking or fracturing of the pole member has been substantially reduced or eliminated to the provision of the bell-shaped lower end portion. Thus it can be seen that the invention accomplishes at least all of its stated objectives.

I claim:

1. A support pole, comprising:

a horizontally disposed base plate for attachment to a footing;

a hollow pole member having upper and lower ends;

said lower end of said pole member being secured to said base plate;

said pole member having a horizontal, quadrilateral cross-section for a majority of its length;

said lower end of said pole member being bell-shaped so as to have a horizontal, circular cross-section at its connection with said base plate.

2. The support pole of claim 1 wherein said quadrilateral cross-section is square.

3. The support pole of claim 1 wherein said base plate has a circular opening formed therein which receives said bell-shaped lower end of said pole member.

4. The support pole of claim 3 wherein said base plate has a top surface and a bottom surface and wherein said bell-shaped lower end of said pole member is positioned between said top and bottom surfaces.

5. The support pole of claim 1 wherein a back-up ring is positioned in the interior of said bell-shaped lower end of said pole member, and wherein said lower end of said pole member is positioned above said base plate.

6. The support pole of claim 1 wherein said pole member is tapered above said bell-shaped lower end portion.

7. The support pole of claim 1 wherein said pole member is welded to said base plate.

8. The support pole of claim 5 wherein said pole member is welded to said back-up ring and said base plate.

9. The support pole of claim 5 wherein said base plate has an opening formed therein for receiving electrical wires extending upwardly therethrough, said opening having a diameter less than the diameter of said back-up ring.

10. The support pole of claim 1 wherein said base plate has an opening formed therein for receiving electrical wires extending upwardly therethrough, said opening having a diameter less than the diameter of said bell-shaped lower end.

* * * * *